US006155273A

United States Patent [19]

Smith et al.

[11] Patent Number: 6,155,273

[45] Date of Patent: Dec. 5, 2000

[54] BEAUTY COIL

[75] Inventors: Mickey Lee Smith; Charles Ray Ashcraft; Carl Carlton Greene, Jr., all of Winston-Salem, N.C.

[73] Assignee: R. J. Reynolds Tobacco Company, Winston-Salem, N.C.

[21] Appl. No.: 09/127,018

[22] Filed: Jul. 31, 1998

[51] Int. Cl.[7] ..... A45D 6/00

[52] U.S. Cl. ..... 132/270; 132/212; 132/319

[58] Field of Search ..... 132/221, 223, 132/226, 212, 270, 319; 604/330, 328, 904; 206/363, 440; 229/87.05, 926, 940

[56] References Cited

U.S. PATENT DOCUMENTS

| | | | |
|---|---|---|---|
| 652,370 | 6/1900 | Murphy | 229/87.05 |
| 1,094,427 | 4/1914 | Cook | 229/940 |
| 2,097,328 | 5/1937 | Mc Bean | 229/87.05 |
| 2,139,436 | 12/1938 | Beck | 132/221 |
| 2,582,992 | 1/1952 | Hergert | 229/926 |
| 2,587,515 | 2/1952 | Parish | 229/87.05 |
| 2,906,273 | 9/1959 | Beauregard | 132/221 |
| 3,092,251 | 6/1963 | Jaggers | 229/926 |
| 3,278,013 | 10/1966 | Banks | 229/926 |
| 3,642,564 | 2/1972 | Walker et al. | 229/926 |
| 4,170,305 | 10/1979 | Hull, Jr. et al. | 206/440 |
| 4,762,230 | 8/1988 | Croce | 229/940 |

*Primary Examiner*—Todd E. Manahan

[57] ABSTRACT

A beauty coil that is in the form of a rod which is comprised of a mass of elongated fibers which run the length of the rod. The fibers are held in a compressed state by an outer sheathing having a pair of longitudinal slits at one end of the rod to form a tab to permit easy removal of the sheath which allows the fiber mass to expand or blossom prior to use.

5 Claims, 1 Drawing Sheet

BEAUTY COIL

BACKGROUND OF THE INVENTION

The device of the present invention relates to a beauty coil product that provides an individual protection from exposure to chemicals used during a perm process or other beauty salon treatments or processes involving chemical applications. More specifically, the invention relates to improvements for a pre-formed beauty coil having a sheath to maintain the plurality of elongated fibers which form a tubular mass in a compressed state.

SUMMARY OF THE INVENTION

The present invention relates to improvements in a pre-formed beauty coil that provides comparable absorbency and additional strength described in U.S. patent application Ser. No. 09/127.019, entitled "Beauty Coil" filed concurrently herewith (Atty. Dkt. No. 2708) which is incorporated herein by reference. The beauty coil of the present invention consists of a preformed beauty coil rod of predetermined length having a plurality of continuous cellulose acetate fibers that are bundled together to form a tubular mass that is wrapped and held in a compressed state by an outer sheathing. Once the sheathing is removed, the compressed fiber mass expands increasing the volume of the fiber mass and provides an absorbent product. Moreover, packaging the beauty coil in a compressed state reduces the volume occupied by the product, thus, lowering shipping, packaging and other associated costs.

To facilitate removal of the sheathing for use, a tear-strip may be located between the tubular mass and sheathing. The tear-strip has an adhesive layer on the side contacting the sheathing to hold the tear-strip in position and prevent it from slipping as it is being pulled. To allow easy access to the end of the tear-strip, the sheath has at least one longitudinal slit, preferably two slits, of predetermined length adjacent at least one side, preferably both sides, of the tear-strip at least one end of the rod. The slit forms a tab to permit the user to grasp the tear-strip more easily.

The present invention also includes a pre-formed beauty coil rod in which the outer sheath may be easily removed through the use of a uniaxially oriented film which will tear in only one direction. The sheath film is oriented so that the film will tear along the longitudinal length of the rod. At least one slit, preferable two slits, of predetermined length at least one end of the rod provides a tab which will permit the user to grasp the tab and strip a longitudinal section of the sheath along its length to facilitate removal of the sheathing for use.

DESCRIPTION OF THE PREFERRED EMBODIMENT

Figure 1:
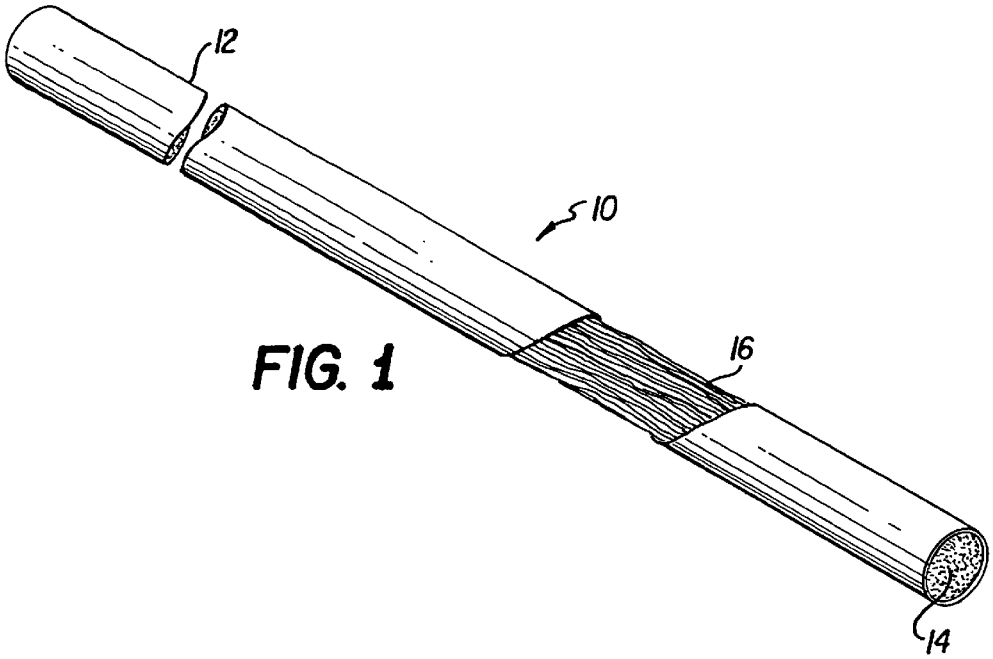
FIG. 1 is a perspective view of the present invention with a portion of the sheath removed to reveal the continuous fibers.

As shown in FIG. 1, a beauty coil rod 10 is provided which is comprised of an outer sheathing 12 and a plurality of continuous fibers 14 that are enclosed within sheath 12 to form a fiber mass 16.

In a preferred embodiment, the continuous fibers 14 may be made from a cellulose acetate tow. However, other continuous fiber tows such as rayon, nylon, polyester, polypropylene and the like can be used. The preferred cellulose acetate tow has a denier per filament in the range of 1.5 to 10.0, preferably 2.7 and a total denier in the range of 15,000 to 80,000, preferably about 32,000. Sheath 12 may be made from a non-porous paper or similar material. The preferred paper has a weight of about 27 grams per square meter with a caliper of about 0.0390 mm.

Using continuous cellulose acetate fibers that run the length of the coil has many advantages over present beauty coils which do not use fibers which run the length of the coil. It has been found that the continuous fibers of the present invention create a beauty coil that appears to be as absorbent as currently available beauty coils. In addition, because the fibers are continuous and run the length of the product, the fiber's ability to resist separation from the fiber mass is enhanced which increases the coil's overall strength.

A manufacturing source of the beauty coil of the present invention is the R.J. Reynolds Tobacco Company of Winston-Salem, N.C. As generally understood, the beauty coil of the present invention is manufactured using a modified KDF filter maker which includes a tear-strip supply and a cutter to form the longitudinal slits and cut the continuous rod into selected lengths. A mono-filament tow, such as cellulose acetate, is drawn into a chamber where the fibers are separated or bloomed to a predetermined bulk density. Afterward, enhancements such as anti-slippage agents, fragrance, talc or other useful additions may be added to the fibers. Next, the fibers are forced into a garniture where the fibers are compacted or compressed to reduce the diameter of the fiber mass and the fiber mass is then wrapped in sheath or web 12 which holds the fiber mass in a compressed state. The slits are provided at spaced intervals along the length of the continuous rod and then the continuous rod is cut to a predetermined length at approximately the midpoint of the slits, thus leaving slits at both ends of the rod. The resulting rods may be cut to lengths of about 25 to 36 inches for optimal end use. Optionally, a tear-strip can be adhered to the sheath as it is drawn through the cigarette filter making machine.

It has been found that a fiber mass that is about 20 millimeters in diameter may be compressed and reduced, as described above, into a fiber mass that is preferably about 7 to 8 millimeters in diameter. This reduction in volume of the fiber mass typically reduces the volume of the beauty coil by bout 70–85% which, in turn, reduces associated shipping, packaging and other handling costs such as storage and the like. This cost savings is particularly important with respect to beauty coil product since the products are relatively light in weight yet occupy a relatively high volume of space.

Figure 2:
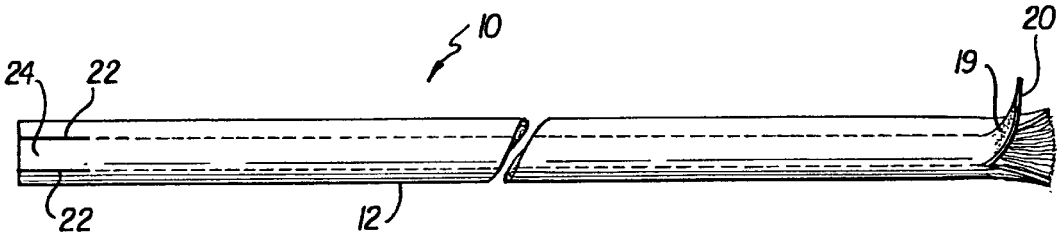
FIG. 2 is a perspective view of an embodiment employing a tear-strip and longitudinal slits to facilitate removal of the outer sheath.

To assist in the removal of the sheath 12 prior to use, a tear-strip 20 may be provided. As shown in FIG. 2, tear-strip 20 is located between sheath 12 and fiber mass 16 and extends longitudinally along the length of the rod and is coextensive with the sheath. Tear-strip 20 may be made from polyester and may also be colored for ease of visibility. The tear-strip may have an adhesive layer 19 on the side which contacts the sheath to hold the tear strip in position and prevent it from slipping from between the sheath and fiber bundle when pulled. Alternately, the tear-strip may be adhered to the sheath at the joint of the sheath wrapper by providing additional adhesive at the joint. In addition, a pair of longitudinal slits 22, approximately 10–15 mm in length are provided in the sheath and extend along the rod 10 adjacent and on opposite sides of the tear-strip to form a tab 24 which permits the user to grasp the tear-strip to more easily remove the sheath.

Figure 3:
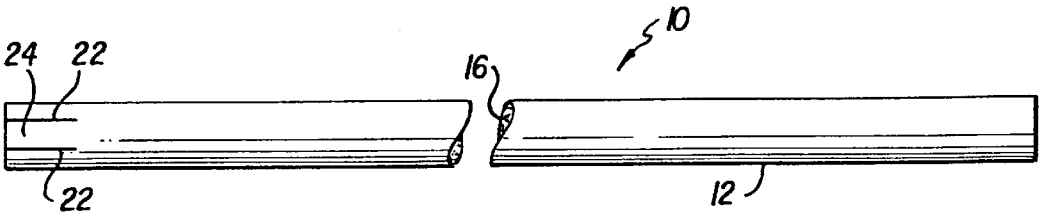
FIG. 3 is a perspective view of the embodiment employing a uniaxially oriented film sheath having a pair of parallel longitudinal slits.

FIG. 3 illustrates a beauty coil rod 10 including an outer sheathing 12 in the form of a uniaxially oriented film such as a uniaxially oriented high density polyethylene or preferentially oriented paper and a plurality of compressed continuous fibers 14 enclosed in the sheath 12. The sheath has a pair of longitudinal slits 22 approximately 10–15 mm in length at one end of the rod extending along the length of the rod to form a tab 24 which may be grasped by the user to facilitate removal of a longitudinal section of the sheath along its length. If desired, the film or paper can be scored so that it will tear more easily along a particular path.

In use, pre-cutting the rods to a predetermined length eliminates the waste associated with endless length beauty coil type products which are currently available. After a stylist selects a rod or coil for use, the sheath is removed by grasping the tab 24 and stripping a longitudinal section of the sheath along its length so that the fibers are then expanded by both a pulling and twisting action. After the fibers are expanded, the stylist places the rod into position on the head of the individual so that the fiber mass forms a liquid absorbent barrier to protect an individual from exposure to chemicals used in a beauty treatment.

It is understood that various changes and modifications to the preferred embodiments described herein would be apparent to one skilled in the art. Changes and modifications can be made without departing from the spirit and scope of the present invention and without diminishing its intended advantages. It is, therefore, intended that such changes and modifications be covered by the following claims.

What is claimed is:

1. A beauty coil for use during a treatment involving a chemical application comprising:

a rod of a length capable of being applied around the head of an individual, said rod comprised of a plurality of continuous liquid absorbent fibers which extend the length of said rod to form a fiber mass;

a sheath which holds said fiber mass in a compressed state until removal of said sheath whereby said fiber mass is allowed to expand;

a tear-strip located between said fiber mass and said sheath adhered to the sheath, said tear-strip extends longitudinally along the length of the rod and is coextensive with the sheath; and a first longitudinal slit in the sheath at one end of the rod adjacent the tear-strip.

2. The beauty coil of claim 1, further including a second longitudinal slit in the sheath at said one end of the rod adjacent and on the opposite side of the tear-strip from said first slit a tab to permit the tear-strip to be grasped.

3. A method of making a beauty coil comprising (a) providing a supply of a mono-filament tow;

(b) blooming said tow to a pre-determined bulk density;

(c) forming a continuous rod of compressed tow;

(d) wrapping said continuous rod of compressed tow in a continuous web to form a sheath, circumventing said rod;

(e) slitting said sheath longitudinally at spaced intervals along the length of said continuous rod; and (f) cutting the continuous rod at approximately the mid-point of said slit to form pre-determined length rods having a slit at each end.

4. The method of claim 3, further including the step of applying a continuous tear-strip to such continuous web prior to wrapping said continuous rod.

5. The method of claim 4, wherein said slitting step includes two longitudinal slits in said sheath at spaced intervals and on opposite sides and adjacent to said tear-strip.

* * * * *